US010972819B2

(12) United States Patent
Kim et al.

(10) Patent No.: US 10,972,819 B2
(45) **Date of Patent: *Apr. 6, 2021**

(54) DISPLAY APPARATUS

(71) Applicant: LG Display Co., Ltd., Seoul (KR)

(72) Inventors: Kwangho Kim, Bucheon-si (KR); KwanHo Park, Bucheon-si (KR); YeongRak Choi, Bucheon-si (KR); Sungtae Lee, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/586,564

(22) Filed: Sep. 27, 2019

(65) Prior Publication Data

US 2020/0029142 A1 Jan. 23, 2020

Related U.S. Application Data

(63) Continuation of application No. 16/128,760, filed on Sep. 12, 2018, now Pat. No. 10,469,928.

(30) Foreign Application Priority Data

Nov. 9, 2017 (KR) ..... 10-2017-0148834

(51) Int. Cl.
*H04R 1/02* (2006.01)
*H04R 17/00* (2006.01)
*H04R 7/04* (2006.01)

(52) U.S. Cl.
CPC ..... *H04R 1/028* (2013.01); *H04R 7/045* (2013.01); *H04R 17/00* (2013.01); *H04R 2440/05* (2013.01); *H04R 2499/15* (2013.01)

(58) Field of Classification Search
None
See application file for complete search history.

(56) References Cited

U.S. PATENT DOCUMENTS

| | | | |
|---|---|---|---|
| 9,420,363 | B2 | 8/2016 | Seo et al. |
| 10,200,772 | B2 | 2/2019 | Ahn et al. |
| 2015/0078604 | A1 | 3/2015 | Seo et al. |
| 2015/0264460 | A1 | 9/2015 | Yanagihara |
| 2015/0341714 | A1 | 11/2015 | Ahn et al. |
| 2015/0350775 | A1 | 12/2015 | Behles et al. |

FOREIGN PATENT DOCUMENTS

| | | | |
|---|---|---|---|
| CN | 104461115 | A | 3/2015 |
| CN | 104756517 | A | 7/2015 |
| CN | 105096778 | A | 11/2015 |

OTHER PUBLICATIONS

Office Action from the China National Intellectual Property Administration dated Apr. 3, 2020 in a corresponding Chinese patent application No. 201811141519.6.

*Primary Examiner* — James K Mooney
(74) *Attorney, Agent, or Firm* — Morgan, Lewis & Bockius LLP

(57) ABSTRACT

A display apparatus including a display panel configured to display an image is disclosed. The display apparatus includes a supporting member on a rear surface of the display panel. The supporting member includes a groove. The display apparatus also includes a sound generator between the display panel and the supporting member, and configured to provide a vibration. The display apparatus further includes a vibration transfer member between the display panel and the sound generator, and configured to transfer the vibration of the sound generator to the display panel to generate sound.

20 Claims, 3 Drawing Sheets

DISPLAY APPARATUS

CROSS-REFERENCE TO RELATED APPLICATION(S)

This application a Continuation of U.S. patent application Ser. No. 16/128,760 filed on Sep. 12, 2018, which claims the benefit of and priority to the Korean Patent Application No. 10-2017-0148834 filed on Nov. 9, 2017. All of the above-identified U.S. and Korean Patent Applications are incorporated herein by reference in their entirety as if fully set forth herein.

BACKGROUND

1. Technical Field

The present disclosure relates to a display apparatus including a sound generator.

2. Discussion of the Related Art

With the advancement of an information-oriented society, various requirements for display products for expressing information in accordance with an electric information signal are increasing. Thus, research is being conducted on various display apparatuses that are thin, light, and have low power consumption.

For example, a display apparatus may be categorized into a liquid crystal display (LCD) apparatus, a field emission display (FED) apparatus, an organic light emitting display apparatus, a light emitting diode display apparatus, a quantum dot light emitting display apparatus, etc.

Among the above types of display apparatuses, the LCD apparatus may include an array substrate including a thin film transistor (TFT), an upper substrate including a color filter and/or a black matrix, and a liquid crystal layer between the array substrate and the upper substrate. An alignment state of the liquid crystal layer is controlled based on an electric field applied across two electrodes in a pixel region, whereby light transmittance is adjusted based on the alignment state of the liquid crystal layer to display an image.

The organic light emitting display apparatus is a self-light emitting display apparatus. It is attracting much attention due to its fast response speed, high light-emitting efficiency, high luminance, and a wide viewing angle in comparison with other available display apparatuses.

Display apparatuses may each include a display panel for displaying an image and a sound device for outputting a sound associated with the image.

However, in display apparatuses, sound generated in the sound device advances toward a lower or rear portion of the display panel. In this arrangement, sound quality may deteriorate, for example, due to an interference with sound reflecting on the wall and floor. Thus, it is difficult to deliver the sound output from the sound device clearly to a user without disrupting his or her immersion experience.

Moreover, if a speaker is added to a display apparatus, a thickness of the display apparatus increases.

SUMMARY

Accordingly, the present disclosure is directed to a display apparatus that substantially obviates one or more of the issues due to limitations and disadvantages of the related art.

Therefore, the inventors have recognized the above-described problems and have performed various experiments for developing a sound generator which is miniaturized for incorporation in display apparatuses and outputs enhanced sound. Through the various experiments, the inventors have developed a display apparatus having a new structure, which includes a sound generator that enhances the quality of output sound and is capable of being miniaturized.

An aspect of the present disclosure is to provide a display apparatus including a sound generator which enhances the quality of output sound and is capable of being miniaturized.

Additional features and aspects will be set forth in the description that follows, and in part will be apparent or may be learned by practice of inventive concepts provided herein. Other features and aspects of the inventive concepts may be realized and attained by the structure particularly pointed out in the written description, or derivable therefrom, and the claims hereof, as well as the appended drawings.

To achieve these features and aspects of the inventive concepts, as embodied and broadly described, a display apparatus includes: a display panel configured to display an image; a supporting member on a rear surface of the display panel, the supporting member including a groove; a sound generator between the display panel and the supporting member, and configured to provide a vibration; and a vibration transfer member between the display panel and the sound generator, and configured to transfer the vibration of the sound generator to the display panel to generate sound.

The display apparatus may further include a mesh structure in the groove.

The display apparatus may further include a mesh structure in the groove, wherein the groove and the mesh structure may be configured to adjust the vibration of the sound generator corresponding to a sound in a low-pitched sound band of the sound generator.

The vibration transfer member may be at a center of the sound generator, and the groove may be at each of two lateral peripheries of the sound generator.

The vibration transfer member may be smaller in size than the sound generator.

The vibration transfer member may be configured to transfer the vibration of the sound generator corresponding to a sound in a high-pitched sound band to the display panel.

The sound generator may be attached to the vibration transfer member by an adhesive member, or the vibration transfer member may be attached to the display panel by an adhesive member.

The sound generator may include a piezoelectric sound generator.

The groove may be formed with a different material from a material of the vibration transfer member.

The display panel may be configured to be vibrated by e sound generator via the vibration transfer member to generate sound.

In another aspect, a display apparatus includes: a display panel configured to display an image; a sound generator on a rear surface of the display panel; and configured to provide a vibration; a vibration transfer member between the display panel and the sound generator, and configured to transfer the vibration of the sound generator to the display panel to generate sound; and a supporting member on a rear surface of the sound generator, the supporting member including a groove which composes at least a portion of a vibration adjustment member configured to adjust the vibration of the sound generator.

The vibration adjustment member may further comprise a mesh structure in the groove.

The mesh structure may be configured to control a flux of air in or out of the groove, and an amount of air corresponding to air damping provided by the vibration adjustment member may be adjusted based on a shape of the mesh structure.

The vibration transfer member may be at a center of the sound generator, and the vibration adjustment member may be at each of two lateral peripheries of the sound generator.

The vibration transfer member may be configured to transfer the vibration of the sound generator corresponding to a sound in a high-pitched sound band of the sound generator to the display panel.

The vibration adjustment member may be configured to adjust the vibration of the sound generator corresponding to a sound it a low-pitched sound band of the sound generator.

The groove may be formed of a softer material than the vibration transfer member.

The vibration transfer member may include one or more of metal, plastic, and a carbon fiber, and the groove may include a fiber material.

The sound generator may include a piezoelectric sound generator.

The display panel may be configured to be vibrated by the sound generator via the vibration transfer member to generate sound.

The vibration adjustment member may be configured to damp the vibration of the sound generator.

The sound generator may be connected to the display panel via the vibration transfer member, and the vibration transfer member may be smaller in size than the sound generator.

Other systems, methods, features, and advantages will be, or will become, apparent to one with skill in the art upon examination of the following figures and detailed description. It is intended that all such additional systems, methods, features, and advantages be included within this description, be within the scope of the present disclosure, and be protected by the following claims. Nothing in this section should be taken as a limitation on those claims. Further aspects and advantages are discussed below in conjunction with example embodiments of the disclosure.

It is to be understood that both the foregoing general description and the following detailed description of the present disclosure are exemplary and explanatory, and are intended to provide further explanation of the disclosure as claimed.

BRIEF DESCRIPTION OF THE DRAWINGS

The accompanying drawings, that may be included, for example, to provide a further understanding of the disclosure and are incorporated in and constitute a part of this specification, illustrate embodiments of the disclosure and together with the detailed description serve to explain various principles.

Figure 1:
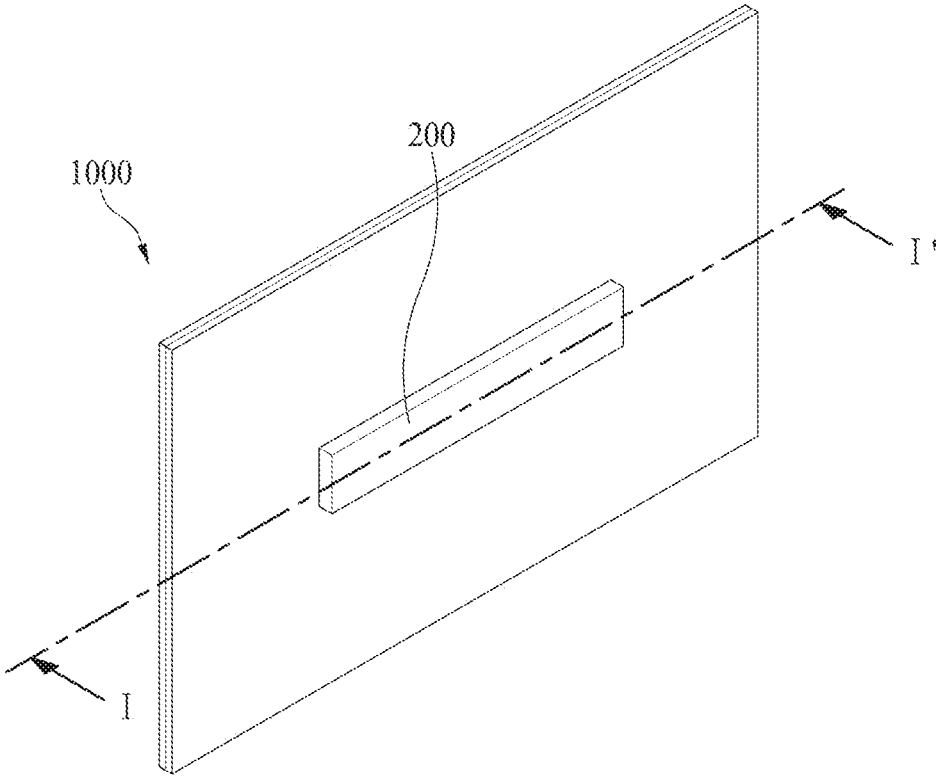
FIG. 1 illustrates a display apparatus according to an example embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, a detailed description of functions or configurations related to this document that are well-known to those skilled in the art may be omitted. The progression of processing steps and/or operations described is an example. The sequence of steps and/or operations is not limited to that set forth herein and may be changed as is known in the art or apparent to those skilled in the art, with the exception of steps and/or operations necessarily occurring in a particular order. Names of the respective elements used in the following explanations are selected only for convenience of writing the specification and may thus be different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Unless otherwise described, like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

In describing a time relationship, when the temporal order is described as, for example, "after," "subsequent," "next," or "before," a case which is not continuous may be included unless a more limiting term, such as "just," "immediate(ly)," or "direct(ly)," is used.

It will be understood that, although the terms like "first," "second," etc., may be used herein to describe various elements, these elements should not be limited by these terms as they are not used to define a particular order. These terms are used only to distinguish one element from another. For example, a first element could be termed a second element, and, similarly, a second element could be termed a first element, without departing from the scope of the present disclosure.

In describing elements of the present disclosure, the terms like "first," "second," "A," "B," "(a)," and "(b)" may be used. These terms are merely for differentiating one element from another element, and the essence, sequence, order, or number of a corresponding element should not be limited by the terms. Also, when an element or layer is described as being "connected," "coupled," or "adhered" to another element or layer, the element or layer can not only be directly connected or adhered to that other element or layer, but also be indirectly connected or adhered to the other element or layer with one or more intervening elements or layers between the elements or layers, unless otherwise specified.

The term "at least one" should be understood as including any and all combinations of one or more of the associated listed items. For example, the meaning of "at least one of a first item, a second item, and a third item" encompasses the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto, unless otherwise specified.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in a co-dependent relationship.

In the present disclosure, the term "display apparatus" may broadly encompass a display apparatus, such as an organic light emitting display (OLED) module or a liquid crystal module (LCM), including a display panel and a driver for driving the display panel. Further, the term "display apparatus" may also broadly encompass a set device (or a set apparatus) a set electronic apparatus such as a notebook computer, a TV, a computer monitor, an automotive display or another type of equipment display including for vehicles, or a mobile electronic device such as a smart phone or electronic pad, etc., which is a complete product (or a final product) including an LCM or an OLD) module, or the like.

Accordingly, in the present disclosure, the term "display apparatus" may include a display apparatus itself, such as an LCM or an OLED module, as well as a set apparatus that is a final consumer apparatus or an application product including the LCM or the OLED module.

Moreover, in some examples, the LCM or the OLED module, including a display panel and a driver, may be referred to as a "display apparatus," and an electronic apparatus as a final product including an LCM or an OLED module may be referred to as a "set apparatus." For example, the display apparatus may include a display panel, such as an LCD or an OLED, and a source printed circuit board (PCB) as a controller for driving the display panel. The set apparatus may further include a set PCB that is a set controller to be electrically connected to the source PCB to control overall operations of the set apparatus or the set device.

A display panel used for an embodiment of the present disclosure may be any type of display panel, including, for example without limitation, a liquid crystal display panel, an organic light emitting diode (OLED) display panel, an electroluminescent display panel, etc. For example, the display panel may be any panel capable of generating sound in accordance with a vibration by a sound generation device. The display panel according to an embodiment of the present disclosure is not limited in its shape or size.

An example liquid crystal display panel may include a plurality of gate lines, a plurality of data lines, and a plurality of pixels respectively provided in a plurality of pixel areas defined by intersections of the gate lines and the data lines. The liquid crystal display panel may include an array substrate including a thin film transistor (TFT) corresponding to a switching device for controlling a light transmittance of each of the plurality of pixels, an upper substrate including a color filter and/or black matrix, and a liquid crystal layer formed between the array substrate and the upper substrate.

An example organic light emitting display panel may include a plurality of gate lines, a plurality of data lines, and a plurality of pixels respectively provided in a plurality of intersections of the gate lines and the data lines. The organic light emitting display panel may include an array substrate including a thin film transistor (ITT) corresponding to an element for selectively applying a voltage to each pixel, an organic light emitting device layer on the array substrate, and an encapsulation substrate disposed on the array substrate to cover the organic light emitting device layer. The encapsulation substrate may protect the TFT and the organic light emitting device layer from an external impact, and may reduce or prevent moisture or oxygen from penetrating into the organic light emitting device layer. The organic light emitting device layer provided on the array substrate may be changed to an inorganic light emitting layer, for example, a nano-sized material layer or the like.

The display panel may further include a backing, such as a metal plate attached to a display panel, but embodiments are not limited to the metal plate. An alternative structure, for example, formed of a different material, may be provided.

The display panel including a sound generation device according to an embodiment of the present disclosure may be implemented at a user interface module in a vehicle, such as a central control panel in an automobile. For example, such a display panel may be configured between two front occupants such that sounds due to vibrations of the display panel propagate towards the interior cabin of the vehicle. As such, the audio experience in the vehicle can be improved in comparison with having speakers only at the interior sides or edges of the vehicle.

Hereinafter, a display apparatus according to example embodiments of the present disclosure will be described in detail with reference to the accompanying drawings.

FIG. 1 illustrates a display apparatus according to an example embodiment of the present disclosure.

If the sound generator 200 is configured with a piezoelectric sound generator, a display apparatus having a smaller thickness than a magnetic type speaker may be manufactured. The magnetic type speaker may include, for example, a magnet and a center pole on a plate, a bobbin near the center pole, and a coil wound around the bobbin.

The inventors have recognized that, if a piezoelectric sound generator is attached to a display panel, a whole area of the piezoelectric sound generator would be fixed. They have recognized that, because this arrangement may hinder bending which in principle generates sound, thereby suppressing a vibration, it may be difficult to reproduce sound having a low-pitched sound band. Therefore, the inventors have recognized a problem of a frequency band tending toward a high-pitched sound band.

Therefore, the inventors have performed various experiments for outputting a sound having a low-pitched sound band. Thus, the inventors have invented a display apparatus including a sound generator having a new structure, which outputs a sound having a low-pitched sound band and reduces the deterioration of a high-pitched sound band. This will be described below with reference to FIGS. 2 and 3.

Figure 2:
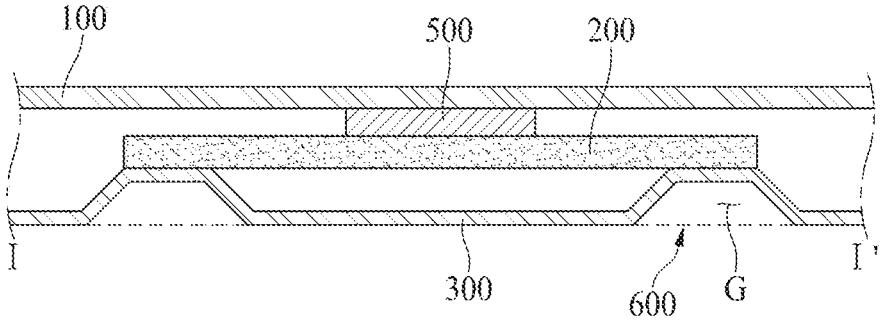
FIG. 2 is a cross-sectional view taken along line I-I' of FIG. 1 and illustrates a display apparatus according to an example embodiment of the present disclosure.

With reference to FIGS. 1 and 2, the display apparatus 1000 may include a display panel 100 for displaying an image and a supporting member 300 on a rear surface of the display panel 100. Also, a sound generator 200 may be on the rear surface of the display panel 100, and may be between the display panel 100 and the supporting member 300.

The display panel 100 may be a light emitting display panel or a flexible light emitting display panel. This will be described below in more detail.

The display panel 100 according to an example embodiment of the present disclosure may include a pixel array substrate including a pixel array with a plurality of pixels, an encapsulation layer which encapsulates the pixel array, and a polarization film which is attached to an upper portion of the encapsulation layer.

The plurality of pixels may be respectively provided in a plurality of pixel areas, that may be defined by a plurality of pixel driving lines. Also, each of the plurality of pixels may include a pixel circuit, including at least two thin film transistors (TFTs) and at least one capacitor, and a light emitting device which emits light with a current supplied from the pixel circuit. For example, the light emitting device may include an organic light emitting layer or a quantum dot light emitting layer. As another example, the light emitting device may include a micro light emitting diode (LED).

The encapsulation layer may protect the TFTs and the light emitting device from an external impact and may prevent moisture or oxygen from penetrating into the light emitting device.

The polarization film may be attached to an upper portion of the encapsulation layer by a film attachment member. The polarization film may circularly polarize external light reflected by the TFTs and/or the pixel driving lines provided on the pixel array substrate, thereby enhancing the visibility and contrast ratio of the display panel 100.

Moreover, the display panel 100 may further include a barrier layer and a touch electrode layer disposed between the encapsulation layer and the polarization film. Also, the display panel 100 may further include a color filter layer on an upper portion of the encapsulation layer.

Alternatively, the encapsulation layer may be replaced or supplemented with an encapsulation substrate which is attached to the pixel array substrate by a filler surrounding the pixel array. In a case where the filler is a transparent filler, the encapsulation substrate may be a transparent encapsulation substrate.

A driving circuit unit may be connected to a pad part provided on the pixel array substrate of the display panel 100, and may supply a driving signal and a data signal to the pixel driving lines to allow each of the pixels to display an image.

Alternatively, the display panel 100 may be a liquid crystal display panel. This will be described below.

The display panel 100 may include a first substrate, a second substrate, and a liquid crystal layer between the first and second substrates. The first substrate may include a pixel electrode or a common electrode for controlling alignment of liquid crystal molecules of the liquid crystal layer and may include a TFT connected to the pixel electrode. The second substrate may include the color filter layer to provide for a display of a color image.

The display panel 100 may drive the liquid crystal layer with an electric field generated from a data voltage and a common voltage which are applied to each of the pixels to control light transmittance of the liquid crystal layer to display an image. The liquid crystal layer may be driven in various driving modes such as a twisted nematic (TN) mode, a vertical alignment (VA) mode, an in-plane switching (IPS) mode, and a fringe field switching (FFS) mode.

For example, the first substrate may be a TFT substrate and may include the plurality of pixels defined by a plurality of gate lines and a plurality of data fines which intersect one another. Each of the pixels may include a TFT connected to a corresponding gate line and a corresponding data line, a pixel electrode connected to the TFT, and a common electrode which is disposed adjacent to the pixel electrode and is supplied with the common voltage. The common electrode may be provided on the second substrate, based on a driving mode of the liquid crystal layer. A driving circuit unit for driving the display panel 100 and the pad part connected to the driving circuit unit may be disposed on one side of the first substrate. The second substrate may be a color filter array substrate and may include the color filter layer. In a case where the display panel 100 is driven in a color filter on TFT (COT) mode or a TFT on color filter (TOC) mode, the color filter layer may be provided on the first substrate.

A backlight unit may be disposed under the display panel 100 and may irradiate light onto the display panel 100. The display panel 100 may control a transmittance of the light emitted from the backlight unit to display an image.

The display apparatus 1000 may be a display module which includes the display panel 100 and the driving circuit unit for driving the display panel 100. For example, the driving circuit unit may include an integrated circuit (IC) chip and a flexible printed circuit board (FPCB). The driving circuit unit, such as a driving IC, for applying a voltage may be mounted on the FPCB. Alternatively, the driving circuit unit may be implemented in a different type, such as a chip-on-film (COF) type.

The gate lines and the data lines of the display panel 100 may be connected to the FPCB. When an electrical signal is applied from the FPCB, the electrical signal may be applied to a source electrode and a drain electrode of the TFT. The FPCB may receive an image signal from the outside of the display panel 100 to apply driving signals to the gate lines and the data lines of the display panel 100.

The FPCB may generate a gate signal and a data signal for driving the display panel 100, and a plurality of timing signals which allow the gate signal and the data signal to be applied at an appropriate time. The FPCB may apply the gate signal and the data signal to the gate lines and the data lines of the display panel 100. Also, the FPCB may include an amplifier.

A cover window may be provided on the display module. The cover window may be attached to a whole surface of the display module or a whole surface of the polarization film.

Moreover, the supporting member 300 may be a plate member which is provided on the rear surface or a whole surface of the display panel 100. For example, the supporting member 300 may face the rear surface of the display panel 100.

As an example, the supporting member 300 may be referred to as a cover bottom, a plate bottom, a back cover, a base frame, a metal frame, a metal chassis, a chassis base, or an m-chassis. Therefore, the supporting member 300 may include all types of frames or plate structures disposed on a rear surface of the display apparatus 1000.

The supporting member 300 may support one or both of a rear surface and a side surface of the display panel 100. In the present disclosure, the supporting member 300 may be, for example, a cover bottom. Alternatively, the supporting member 300 may further include a middle cabinet which is coupled or connected to the cover bottom, surrounds the side surface of the display panel 100, accommodates a peripheral end portion of the display panel 100, and supports the display panel 100. For example, the middle cabinet may include a ⊣-shaped (or a T-shape rotated 90 degrees) cross-sectional surface. The supporting member 300 may include a cover bottom, or may include a cover bottom and a middle cabinet, but embodiments are not limited thereto. In other embodiments, the supporting member 300 may include a structure which covers the rear surface or the side surface of the display panel 100.

The supporting member 300 may surround the entire side surface and rear surface of the display apparatus, thereby protecting the display apparatus. The supporting member 300 may have relatively high rigidity for its weight. Accordingly, the supporting member 300 may protect the display apparatus without a significant increase in weight of the display apparatus.

The sound generator 200 may include a piezoelectric sound generator. The sound generator may be referred to as an "actuator," an "exciter," or a "transducer," but embodiments are not limited to these terms.

Figure 3:
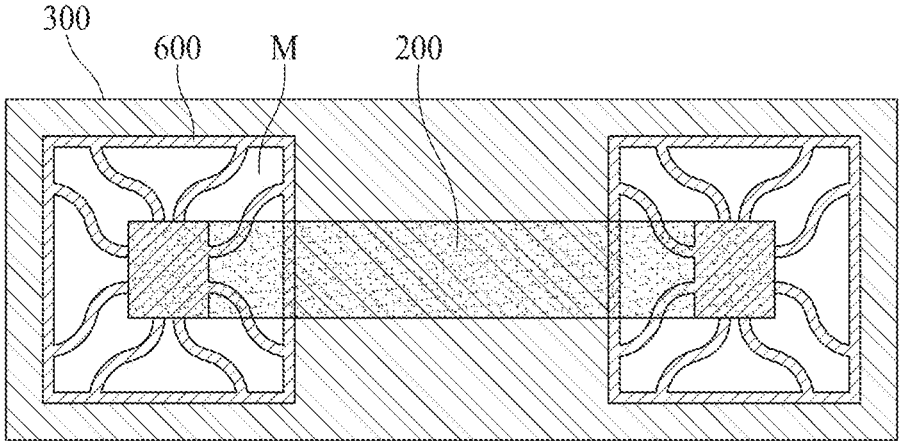
FIG. 3 is a plan view according to an example embodiment of the present disclosure.

FIG. 2 is a cross-sectional view taken along line I-I' of FIG. 1 and illustrates a display apparatus according to an embodiment of the present disclosure. FIG. 3 is a plan view according to an embodiment of the present disclosure.

As shown in FIG. 2, a supporting member 300 and a sound generator 200 may be on a rear surface of a display panel 100. The sound generator 200 may be between the display panel 100 and the supporting member 300. A vibration transfer member 500 may be between the display panel 100 and the sound generator 200.

The vibration transfer member 500 may be between the display panel 100 and the sound generator 200 without creating a large void between the sound generator 200 and the display panel 100. Therefore, the void between the sound generator 200 and the display panel 100 may be reduced.

A size of the vibration transfer member 500 may be set equal to or less than that of the sound generator 200. If the size of the vibration transfer member 500 is less than that of the sound generator 200, the sound generator 200 may be attached to less than the entire surface of the display panel 100. Therefore, a contact area between the sound generator 200 and the display panel 100 would be less than the entire surface area of the display panel 100, thereby suppressing a sound output from the sound generator 200 from tending toward a higher-pitched sound band. Accordingly, by reducing an area at which the sound generator 200 and the display panel 100 are fixed to each other, the transferability of a high-pitched sound generated by the sound generator 200 to the display panel 100 may be enhanced. Therefore, the vibration transfer member 500 may transfer a sound having a high-pitched sound band of the sound generator 200 to the display panel 100.

The vibration transfer member 500 may be formed of a hard material. Thus, a vibration having the high-pitched sound band of the sound generator 200 may be efficiently and smoothly transferred to the display panel 100, thereby reducing or preventing a high-pitched sound from being deteriorated. Accordingly, a sound reproduction band may expand, and the quality of output sound, including a sound having the high-pitched sound band, may be improved.

In order for the sound generator 200 to output a sound having a low-pitched sound band, a vibration adjustment member 600 may be employed under the sound generator 200. The vibration adjustment member 600 may allow a suspension structure to be implemented in the supporting member 300. The suspension may act as a spring, and may enable a vertical or up-and-down motion of the sound generator 200 to be smooth. This may decrease a resonance frequency, and reduce or prevent lateral twisting of the sound generator 200 to reduce distortion of a sound. The suspension may be referred to as a damper, a spider, and an edge, but embodiments are not limited to these terms.

In order to implement the suspension structure, the supporting member 300 may include a groove G. The supporting member 300 may be formed of a metal material, and the groove G may be formed through a mold. For example, the groove G may be formed through a blanking mold or a stamping mold, but embodiments are not limited thereto. In a case where the groove G is formed through the blanking mold or the stamping mold, the groove G may be easily formed in a desired region of the supporting member 300.

As illustrated in FIGS. 2 and 3, a mesh structure M may be provided in or near the groove G. The mesh structure M may be referred to, for example, as a mesh net. The mesh structure M may reduce or prevent penetration of external particles caused by the groove G. The mesh structure M may control the flux of air to adjust the amount of air, thereby improving a sound output characteristic. For example, as the mesh structure M is more sparsely or non-densely configured, a relatively lower sound may be reproduced or generated. However, in this case, a sound tone may become unclear, the flexibility or springiness may be reduced, and the possibility of particles flowing in from the outside may increase. On the other hand, as the mesh structure M is more densely configured, a relatively higher low-pitched sound may be reproduced. However, in this case, a sound tone may become clearer, the flexibility or springiness may become better, and the possibility of particles flowing in from the outside may decrease. Therefore, the amount of air corresponding to air damping may be adjusted based on a shape of the mesh structure M, a low-pitched sound having a desired sound band may be reproduced or generated, and the performance in the low-pitched sound band may be enhanced.

Therefore, the vibration adjustment member 600 implemented with the groove G and the mesh structure M may be on a lower portion of the sound generator 200. The vibration adjustment member 600 may reinforce or adjust a low-pitched sound by using the groove G and the mesh structure M, thereby controlling or adjusting the reproduction band and sound quality of the low-pitched sound band of the sound generator 200.

Moreover, the vibration adjustment member 600 may be in a periphery of the display panel 100. For example, the vibration adjustment member 600 may be disposed in a periphery of the sound generator 200. Also, the vibration adjustment member 600 may be at each of both lateral peripheries of the sound generator 200. Therefore, the vibration adjustment member 600 may be in the supporting member 300, and may preset a position of the sound generator 200. As a result, the vibration adjustment member 600 may additionally perform an alignment function when bonding or attaching the display panel 100 to the supporting member 300. Thus, the process of bonding or attaching the display panel 100 to the supporting member 300 may be improved, whereby a manufacturing process may be more easily performed.

In addition, when a low frequency vibration is being performed, the vibration adjustment member 600 may reduce or prevent lateral twisting, thereby reducing distortion of a sound and controlling the amount of air to improve the reproduction range and sound quality of the low-pitched sound band. The vibration adjustment member 600 may decrease a lateral vibration of the sound generator 200, thereby reducing the loss, caused by the lateral vibration, of a vibration transferred to the display panel 100. The vibration adjustment member 600 may reinforce or adjust the vibration transferred to the display panel 100 by using a vertical or up-and-down vibration.

Therefore, the vibration adjustment member 600 may lower a frequency band of the vibration to reinforce or control a sound having the low-pitched sound band. Also, the vibration adjustment member 600 may reduce distortion of a sound.

The groove G of the vibration adjustment member 600 may be formed with a soft material. The soft material may be, for example, a fiber material, but embodiments are not limited thereto.

If the groove G of the vibration adjustment member 600 is formed with the soft material, a resonance frequency may be lowered. This will be described below with reference to the following Equation (1).

If a stiffness of a damper of a sound generator is s and a mass is m, a resonant frequency "fo" of a sound wave generated by a vibration of the sound generator may be determined as expressed in the following Equation (1):

$$f_o = \frac{1}{2\pi} \times \sqrt{\frac{s}{m}} \qquad \text{Equation (1)}$$

If the groove of the vibration adjustment member 600 functioning as a damper is formed with a soft material, as in Equation (1), the stiffness of the sound generator may be reduced. Thus, the resonance frequency may be reduced, thereby enhancing a sound characteristic corresponding to the low-pitched sound band.

The vibration transfer member 500 may be attached to the sound generator 200 by an adhesive member. For example, the adhesive member may be a double-sided tape, a single-sided tape, an adhesive, and/or a bond, but embodiments are not limited thereto. Also, the adhesive member may be attached to a surface of the display panel 100, on which surface the vibration transfer member 500 is attached. This may, for example, mitigate a potential problem where the adhesive member is attached to an undesired portion or a potential problem where the material cost of the adhesive member increases. However, embodiments are not limited thereto. In other embodiments, the adhesive member may be attached to a whole surface of the display panel 100.

Moreover, the vibration transfer member 500 may be formed of a material which differs from that of the vibration adjustment member 600. For example, the vibration transfer member 500 may be formed of a hard material which differs from that of the vibration adjustment member 600. The hard material may be, for example, one of metal, plastic, and a carbon fiber, but embodiments are not limited thereto. Also, the metal may be copper (Cu), but embodiments are not limited thereto. Also, the groove G of the vibration adjustment member 600 may include a fiber material, but embodiments are not limited thereto.

Therefore, the vibration transfer member 500 and the vibration adjustment member 600 including different materials may be respectively disposed on an upper portion and a lower portion of the sound generator 200. Thus, a sound reproduction band may expand to include a low-pitched sound band to a high-pitched sound band, thereby reducing or preventing sound distortion to enhance output sound quality. Also, the vibration adjustment member 600 may perform an alignment function, thereby improving the assemblability of, or the process of attaching or bonding, the display panel 100 to the supporting member 300.

In the display apparatus according to an example embodiment of the present disclosure, because a sound having the low-pitched sound band is output by using the vibration transfer member 500, the sound generator 200 may output a sound having the low-pitched sound band. Thus, the sound generator 200 may output a sound having the high-pitched sound band and a sound having the low-pitched sound band. Also, through an experiment, the inventors have confirmed that if the vibration transfer member 500 is not provided, a low-pitched sound is reproduced at 1,400 Hz, and that if the vibration transfer member 500 is provided, a low-pitched sound may be generated at 500 Hz. Here, in an example embodiment, the high-pitched sound band may include frequencies of 3 kHz or higher, and the low-pitched sound band may include frequencies of 200 Hz or lower. However, embodiments are not limited thereto.

A three-point or three-area supporting structure may be configured with respect to the sound generator 200 by using the vibration transfer member 500 on an upper portion of the sound generator 200 and the vibration adjustment member 600 in each of two sides, or left and right sides, of the lower portion of the sound generator 200. Thus, a frequency band capable of reproduction may expand, and lateral twisting may be reduced or prevented, thereby reducing or preventing distortion of a sound. Also, the vibration transfer member 500 and the vibration adjustment member 600 may reduce a lateral vibration of the sound generator 200. Thus, the loss of a vibration transferred to the display panel 100 caused by the lateral vibration may be reduced, a frequency band capable of reproduction may be expanded, and lateral twisting may be reduced or prevented to reduce or prevent distortion of a sound.

Hereinafter, an example sound generation method of the sound generator 200 will be described with reference to FIGS. 4A and 4B.

Figure 4A:
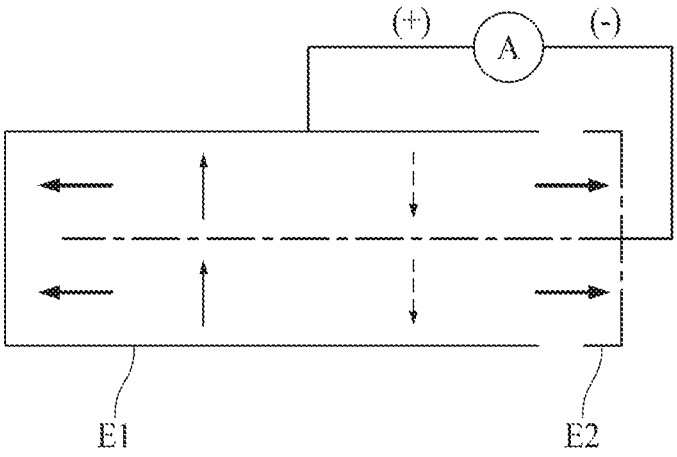
FIGS. 4A and 4B illustrate a sound generation method of a sound generator according to an example embodiment of the present disclosure.
Figure 4B:
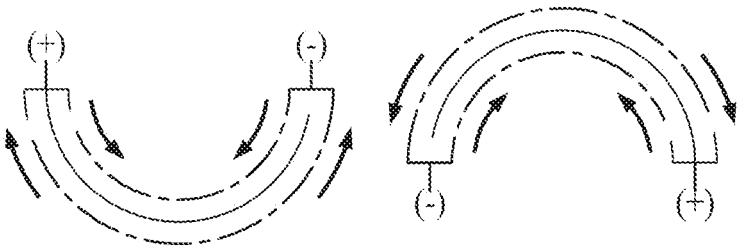

FIGS. 4A and 4B illustrate a sound generation method of a sound generator according to an example embodiment of the present disclosure.

A piezoelectric element may be an element having properties (i.e., a piezoelectric effect) where electrical polarization occurs based on an external force to cause a potential difference. When a voltage is applied, deformation or stress may occur. For example, the piezoelectric element configuring the sound generator may be formed of a material having a piezoelectric characteristic among crystal, tourmaline, Rochelle salt ($C_4H_4KNaO_6.4H_2O$), barium titanate ($BaTiO_3$), monoammonium phosphate ($NH_4H_2PO_4$), zinc oxide (ZnO), cadmium sulfide (CdS), aluminum nitride (AlN), and a ceramic material having a perovskite structure. For example, perovskite may be calcium metatitanate ($CaTiO_3$), or barium titanate ($BaTiO_3$), but embodiments are not limited thereto.

Moreover, the piezoelectric element may be formed by sintering a material having a piezoelectric effect. The piezoelectric element may be formed of an insulation elastic material, such as silicon, acryl, or urethane, or a piezoelectric polymer material such as poly vinylidene fluoride (PVDF) or PZT (lead zirconate titanate; a generic name for zirconate $PbZrO_3$ and titanate $PbTiO_3$). Examples of PZT may include, without limitation, PZT-PVDF, PZT-silicon rubber, PZT-epoxy, PZT-foam polymer, and PZT-foam urethane. Examples of PVDF may include polyvinylidene fluoride trifluoroethylene (PVDF-TrFE), but embodiments are not limited thereto. PVDF, a semi-crystalline ferroelectric polymer, may have a high elastic coefficient and good flexibility and may be relatively easy to manufacture in a film form. Also, PVDF may have characteristics of being lightweight, flexible without being easily broken, and robust to an impact, and may have a characteristic of being relatively easy to manufacture in a flexible film form.

In other embodiments, the piezoelectric element configuring the sound generator may include, without limitation, piezopolymer including at least one of PVDF homopolymer, PVDF copolymer, PVDF terpolymer, cyano-polymer, cyano-copolymer, and BN polymer, and may be manufactured in a flexible film form. The PVDF copolymer may be, for example, PVDF-TrFE, PVDF-TEE, PVDF-CTFE, or PVDF-CFE, but embodiments are not limited thereto. The PVDF terpolymer may be, for example, PVDF-TrFe-CFE or PVDF-TrFE-CTFE, but is not limited thereto. The cyano-copolymer may be, for example, PVDCN-vinyl acetate or PVDCN-vinyl propionate, but embodiments are not limited thereto. The BN polymer may be, for example, polyaminoboran or polyaminodifluoroboran, but embodiments are not limited thereto.

Therefore, the piezoelectric element may have a structure where the piezoelectric element including an electrode is attached to both surfaces of a metal vibration plate or a polymer by an adhesive. A shape of the piezoelectric element may be deformed by applying an alternating current (AC) voltage to both surfaces of the piezoelectric element, and a sound may be generated by transferring the shape deformation of the piezoelectric element to a vibration plate.

A piezoelectric speaker using the piezoelectric element may be categorized into a film type piezoelectric speaker and a stacked type piezoelectric speaker. The film type piezoelectric speaker uses the principle where an electrode is formed of a piezoelectric film material in each of an upper portion and a lower portion, and a sound may be generated by applying a voltage.

The stacked type piezoelectric speaker may incorporate a plurality of layers including a piezoelectric element between two electrodes. An AC voltage may be applied between the two electrodes, and the stacked type piezoelectric speaker may be bent upward and downward according to the AC voltage. The piezoelectric element may use the above-described materials, but embodiments are not limited thereto. Here, an example where a sound generator is configured with the staked type piezoelectric speaker is described, but embodiments are not limited thereto. In other embodiments, the film type piezoelectric speaker may also be incorporated. This will be described below with reference to FIGS. 4A and 4B.

FIG. 4A illustrates a side structure of a sound generator according to an example embodiment of the present disclosure.

As shown in FIG. 4A, a + voltage and a − voltage are respectively applied to a first electrode E1 and a second electrode E2 by using a power unit A. When a voltage having a direction opposite to a polarization direction (illustrated as a thin solid line in an upward direction) is applied, a stress may be generated based on a piezoelectric effect, and deformation based on contraction or expansion in a displacement direction (illustrated as a thick solid line in a lateral direction) may occur. Therefore, as illustrated in FIG. 4B, deformation caused by an AC voltage may occur in a piezoelectric type sound generator, and the piezoelectric type sound generator may be changed to a vertical motion mode or an up and down mode, or may be bent in a displacement direction (illustrated as a thick solid line). A vibration may be generated based on the vertical motion mode, and a sound may be generated based on the vibration.

The sound generator according to an embodiment of the present disclosure may be applied as a sound generator provided in a display apparatus. The display apparatus according to an embodiment of the present disclosure may be applied, for example, to mobile devices, video phones, smart watches, watch phones, wearable devices, foldable devices, rollable devices, bendable devices, flexible devices, curved devices, portable multimedia players (PMPs), personal digital assistants (PDAs), electronic organizers, desktop personal computers (PCs), laptop PCs, netbook computers, workstations, navigation devices, automotive navigation devices, automotive display devices, televisions (TVs), notebook computers, monitors, cameras, camcorders, home appliances, etc. The display apparatus according to an embodiment of the present disclosure may include a sound generator smaller in size in a case where the display apparatus is incorporated in a mobile device. Also, the piezoelectric sound generator employed in a configuration according to an embodiment of the present disclosure may output a sound in a wide range of sound band from the low-pitched sound band to the high-pitched sound band.

A display apparatus according to an embodiment of the present disclosure will be described below.

A display apparatus according to an example embodiment of the present disclosure includes a display panel configured to display an image, a supporting member on a rear surface of the display panel and including a groove, a sound generator between the display panel and the supporting member, and a vibration transfer member between the display panel and the sound generator.

According to some embodiments of the present disclosure, the display apparatus may further include a mesh structure in the groove.

According to some embodiments of the present disclosure, the display apparatus may further include a mesh structure in the groove, wherein the groove and the mesh structure may be configured to adjust a sound having a low-pitched sound band of the sound generator.

According to some embodiments of the present disclosure, the vibration transfer member may be in a center of the sound generator, and the groove may be in each of both peripheries of the sound generator.

According to some embodiments of the present disclosure, a size of the vibration transfer member may be less than a size of the sound generator.

According to some embodiments of the present disclosure, the vibration transfer member may be configured to transfer a sound having a high-pitched sound band of the sound generator to the display panel.

According to some embodiments of the present disclosure, the sound generator may be attached to the vibration transfer member by an adhesive member, or the vibration transfer member may be attached to the display panel by an adhesive member.

According to some embodiments of the present disclosure, the sound generator may include a piezoelectric sound generator.

A display apparatus according to an example embodiment of the present disclosure includes a display panel configured to display an image, a sound generator disposed on a rear surface of the display panel, a vibration transfer member between the display panel and the sound generator, a supporting member d on a rear surface of the sound generator and including a groove, and a vibration adjustment member implemented by the groove.

According to some embodiments of the present disclosure, the display apparatus may further include a mesh structure in the groove.

According to some embodiments of the present disclosure, the vibration transfer member may be in a center of the sound generator, and the vibration adjustment member may be in each of both peripheries of the sound generator.

According to some embodiments of the present disclosure, the vibration transfer member may be configured to transfer a sound having a high-pitched sound band of the sound generator to the display panel, and the vibration adjustment member may be configured to adjust a sound having a low-pitched sound band of the sound generator.

According to some embodiments of the present disclosure, the vibration transfer member may include one of metal, plastic, and a carbon fiber, and the groove may include a fiber material.

According to some embodiments of the present disclosure, the sound generator may include a piezoelectric sound generator.

As described above, according to the embodiments of the present disclosure, the sound generation member and the vibration adjustment member may be provided, thereby providing a display apparatus for outputting sounds having the low-pitched sound band and the high-pitched sound band.

Also, in the display apparatus according to the example embodiments of the present disclosure, since the vibration adjustment member may additionally perform an alignment function, the assemblability of, or a process of bonding or attaching, the display panel to the supporting member may be improved.

In addition, the display apparatus according to the example embodiments of the present disclosure may include a vibration adjustment member, thereby reducing or preventing the distortion of a sound to enhance output sound quality.

Moreover, the display apparatus according to the example embodiments of the present disclosure may include a vibration adjustment member having a groove and a mesh structure. Thus, the amount of incoming air may be adjusted by the groove and the mesh structure so that the reproduction band and sound quality of the low-pitched sound band may be controlled or adjusted.

Additionally, the display apparatus according to the example embodiments of the present disclosure may include a sound generation member and a vibration adjustment member, and thus may reduce or prevent the deterioration of a high-pitched sound, thereby expanding the sound reproduction band to enhance sound quality.

Also, according to the example embodiments of the present disclosure, the vibration adjustment member may be formed of a different material from the sound generation member or the vibration transfer member, thereby providing a display apparatus capable of outputting sounds of a wide band from the low-pitched sound band to the high-pitched sound band.

Furthermore, in the display apparatus according to the example embodiments of the present disclosure, the vibration adjustment member may be formed of a different material from the sound generation member or the vibration transfer member, thereby reducing or preventing the distortion of a sound to enhance sound quality.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display apparatus, comprising:

a display panel configured to display an image;

a supporting member on a rear surface of the display panel, the supporting member including a groove;

a mesh structure in the groove;

a sound generator between the display panel and the supporting member, and configured to provide a vibration; and a vibration transfer member between the display panel and the sound generator, and configured to transfer the vibration of the sound generator to the display panel to generate sound.

2. The display apparatus of claim 1, wherein the groove and the mesh structure are configured to adjust the vibration of the sound generator corresponding to a sound in a low-pitched sound band of the sound generator.

3. The display apparatus of claim 1, wherein the groove is at a rear surface of the supporting member facing away from the display panel and has sidewalls at two or more lateral sides.

4. The display apparatus of claim 1, wherein:

the supporting member further includes another groove in a rear surface of the supporting member;

the vibration transfer member is at a center of the sound generator, and the groove and the another groove are at two lateral peripheries of the sound generator, respectively.

5. The display apparatus of claim 1, wherein the vibration transfer member is smaller in size than the sound generator, or wherein the vibration transfer member is configured to transfer the vibration of the sound generator corresponding to a sound in a high-pitched sound band to the display pane.

6. The display apparatus of claim 1, further comprising an adhesive member, the adhesive member attaching the vibration transfer member to the sound generator or to the display panel.

7. The display apparatus of claim 1, wherein the sound generator comprises a piezoelectric sound generator.

8. The display apparatus of claim 1, wherein the groove is formed with a different material from a material of the vibration transfer member.

9. The display apparatus of claim 1, wherein the display panel is configured to be vibrated by the sound generator via the vibration transfer member to generate sound.

10. A display apparatus, comprising:

a display panel configured to display an image;

a sound generator on a rear surface of the display panel, and configured to provide a vibration;

a vibration transfer member between the display panel and the sound generator, and configured to transfer the vibration of the sound generator to the display panel to generate sound; and a supporting member on a rear surface of the sound generator, the supporting member including a vibration adjustment member configured to adjust the vibration of the sound generator, wherein the vibration adjustment member includes a mesh structure.

11. The display apparatus of claim 10, wherein:

the supporting member includes a groove which composes at least a portion of the vibration adjustment member, and the groove includes the mesh structure.

12. The display apparatus of claim 11, wherein the mesh structure is configured to control a flux of air in or out of the groove, and an amount of air corresponding to air damping provided by the vibration adjustment member is adjusted based on a shape of the mesh structure.

13. The display apparatus of claim 11, wherein the groove is at a rear surface of the supporting member facing away from the display panel and has sidewalls at two or more lateral sides.

14. The display apparatus of claim 11, wherein the groove is formed of a less rigid material than the vibration transfer member.

15. The display apparatus of claim 14, wherein:

the vibration transfer member comprises one or more of metal, plastic, and a carbon fiber, and the groove comprises a fiber material.

16. The display apparatus of claim 10, further comprising another vibration adjustment member, wherein:

the vibration transfer member is at a center of the sound generator, and the vibration adjustment member and the another vibration adjustment member are at two lateral peripheries of the sound generator, respectively.

17. The display apparatus of claim 10, wherein the vibration transfer member is configured to transfer the vibration of the sound generator corresponding to a sound in a high-pitched sound band of the sound generator to the display panel, or wherein the vibration adjustment member is configured to adjust the vibration of the sound generator corresponding to a sound in a low-pitched sound band of the sound generator.

18. The display apparatus of claim 10, wherein the sound generator comprises a piezoelectric sound generator, or wherein the sound generator is connected to the display panel via the vibration transfer member, and the vibration transfer member is smaller in size than the sound generator.

19. The display apparatus of claim 10, wherein the display panel is configured to be vibrated by the sound generator via the vibration transfer member to generate sound.

20. The display apparatus of claim 10, wherein the vibration adjustment member is configured to damp the vibration of the sound generator.

* * * * *